US005834885A

United States Patent [19]

Itoh et al.

[11] Patent Number: 5,834,885

[45] Date of Patent: Nov. 10, 1998

[54] FIELD EMISSION CATHODE AND METHOD FOR MANUFACTURING SAME

[75] Inventors: Shigeo Itoh; Teruo Watanabe; Kazuyoshi Ohtsu; Masateru Taniguchi, all of Mobara, Japan

[73] Assignee: Futaba Denshi Kogyo K.K., Mobara, Japan

[21] Appl. No.: 761,134

[22] Filed: Dec. 6, 1996

[51] Int. Cl.[6] ..... H01J 1/62

[52] U.S. Cl. ..... 313/336; 313/308; 313/309; 313/336; 313/351

[58] Field of Search ..... 313/497, 495, 313/496, 336, 309, 351, 308

[56] References Cited

U.S. PATENT DOCUMENTS

| | | | |
|---|---|---|---|
| 5,189,341 | 2/1993 | Itoh et al. | 315/169.1 |
| 5,256,936 | 10/1993 | Itoh et al. | 313/495 |
| 5,347,133 | 9/1994 | Toki et al. | 250/492.3 |
| 5,381,069 | 1/1995 | Itoh et al. | 313/310 |
| 5,402,041 | 3/1995 | Kishino et al. | 315/169.1 |
| 5,469,014 | 11/1995 | Itoh et al. | 313/308 |
| 5,499,939 | 3/1996 | Itoh et al. | 445/73 |
| 5,584,739 | 12/1996 | Itoh et al. | 445/24 |
| 5,589,738 | 12/1996 | Onodaka et al. | 315/169.1 |
| 5,594,298 | 1/1997 | Itoh et al. | 313/336 |

*Primary Examiner*—Ashok Patel
*Attorney, Agent, or Firm*—Oblon, Spivak, McClelland, Maier & Neustadt, P.C.

[57] ABSTRACT

A field emission cathode which is capable of increasing bond strength between emitters and a resitive layer and a method for manufacturing the same which is capable of facilitating manufacturing of the cathode. The field emission cathode includes a laminated board, which includes a substrate, and at least a cathode electrode layer, a resitive layer, an insulating layer and a gate electrode layer which are deposited in the form of a film on the substrate in order. The gate electrode layer and insulating layer are formed with through-holes so as to commonly extend through the gate electrode layer and insulating layer. The cathode also includes buffer layers made of an insulating material and formed on portions of the resistive layer exposed via the through-holes, as well as emitters arranged on the buffer layers, respectively, resulting in bond strength between the resistive layer and the emitters being increased.

3 Claims, 4 Drawing Sheets

FIELD EMISSION CATHODE AND METHOD FOR MANUFACTURING SAME

BACKGROUND OF THE INVENTION

This invention relates to a field emission cathode known to be a cold cathode and a method for manufacturing the same.

When an electric field set to be about $10^9$ (V/m) is applied to a surface of a metal material or that of a semiconductor material, a tunnel effect occurs to permit electrons to pass through a barrier, resulting in the electrons being discharged to a vacuum even at a normal temperature. Such a phenomenon is referred to as "field emission" and a cathode constructed so as to emit electrons based on such a principle is referred to as "field emission cathode" or "field emission element".

Recently, development of semiconductor fine-processing techniques permits a field emission cathode (hereinafter also referred to as "FEC") of the surface emission type to be constructed of field emission cathode elements having a size as small as microns. Arrangement of the thus constructed field emission cathodes in large numbers on a substrate is expected to permit the field emission cathodes to act as an electron source for a display device of the flat type or any electronic device.

Such a conventional field emission cathode is typically represented by a field emission cathode (FEC) of the Spindt type by way of example, which is generally constructed in such a manner as shown in FIG. 3. More particularly, the FEC includes a substrate 100 on which a cathode electrode layer 101 is formed. Then, the cathode electrode layer 101 is formed thereon with a resistive layer 102, an insulating layer 103 and a gate electrode layer 104 in order. The insulating layer 103 is formed with through-holes, in each of which an emitter 115 of a conical configuration is arranged in a manner to be exposed through each of openings of the gate electrode layer 104 formed so as to communicate with each of the through-holes of the insulating layer 103.

Use of fine processing techniques for manufacturing of such an FEC permits a distance between the conical emitters 115 and the gate electrode layer 104 to be reduced to a level less than a micron, so that application of a voltage as low as tens of volts between the conical emitters 115 and the gate electrode layer 104 leads to emission of electrons from the conical emitters 115.

Then, an anode substrate 116 on which a phosphor material is deposited is arranged above the substrate 100 having the FEC arranged in large numbers thereon in an array-like manner, resulting in the FEC being provided. Thus, application of voltages of $V_{GE}$ and $V_A$ to the FEC thus constructed as shown in FIG. 3 permits electrons to be discharged from the conical emitters 115 and impinge on the phorphor material on the anode substrate 116, resulting in the phorphor material emitting light.

Now, manufacturing of the conventional Spindt-type FEC shown in FIG. 3 will be described with reference to FIGS. 4(*a*) to 4(*f*).

First, as shown in FIG. 4(*a*), niobium (Nb) which is a material for the cathode electrode layer 101 is arranged in the form of a film on the substrate 100 by sputtering. The substrate 100 may be made of glass or the like. This results in the cathode electrode layer or thin-film conductive layer 101. Then, the thin-film conductive layer 101 is formed thereon with a film of amorphous silicon (α-Si) doped with an impurity by chemical vapor deposition (CVD), to thereby provide the resistive layer 102, followed by formation of a film of silicon oxide ($SiO_2$) on the resistive layer 102 by CVD, resulting in the insulating layer 103 being provided. Thereafter, the insulating layer 103 is formed thereon with a film of Nb by sputtering, to thereby provide the gate electrode layer 104, so that a laminated board may be formed.

Then, a photoresist layer 111 is deposited on the gate electrode layer 104 which is an uppermost layer of the laminated board and then subject to patterning by photolithography while being covered with a mask 112, resulting in the photoresist layer 111 being formed with an opening pattern.

Subsequently, the laminated board is subject to reactive ion etching (RIE) on a side of the photoresist layer 111 by means of any suitable gas such as $SF_6$ or the like, resulting in anisotropic etching being carried out on the laminated board, so that the gate electrode layer 104 is formed with the openings 113 like the photoresist pattern as shown in FIG. 4(*b*).

Thereafter, the laminated board is subject to dry etching, resulting in the insulating layer 103 being subject to anisotropic etching, so that the insulating layer 103 is formed with the above-described through-holes designated at reference numerals 114 as shown in FIG. 4(*c*). Then, aluminum (Al) is formed on the lamited board by oblique vapor deposition (angle: Θ) while rotating the laminated board in the same plane, so that a peel layer 105 may be provided. This results in Al being selectively deposited on only a surface of the gate electrode layer 104 without being deposited in the through-holes 114, as shown in FIG. 4(*d*).

Then, molybdenum (Mo) which is an emitter material for the conical emitters 115 is deposited by vapor deposition on a side of the resistive layer 102 facing the through-holes 114. This results in the Mo or emitter material being deposited on the resistive layer 102, as well as on the peel layer 105 as indicated at reference numeral 106, as shown in FIG. 4(*d*). The emitter material 106 deposited on the peel layer 105 closes an opening of each of the through-holes 114 and the emitter material deposited on the resistive layer 102 provides the conical emitters 115.

Subsequently, the laminated board is dipped in a phosphoric acid solution for dissolving the peel layer 105, so that the peel layer 105 on the gate electrode layer 104 and the emitter material 106 on the peel layer 105 are removed. This results in the FEC formed into such a configuration as shown in FIG. 4(*e*).

In such manufacturing of the FEC as described above, the through-holes 114 are formed via the insulating layer 103 as shown in FIG. 4(*c*). This requires to form a pattern of the through-holes by means of the photoresist layer and then subject Nb to etching by $SF_6$, followed by etching of the $SiO_2$ insulating layer 103 using $CHF_3$+$O_2$ or the like. Unfortunately, this causes a part of the α-Si resistive layer 102 to be likewise etched by dry etching, leading to deterioration of a surface of the resistive layer 102.

Thus, formation of the conical emitters 115 by deposition of the emitter material Mo on the surface of the resistive layer 102 causes bonding between the resistive layer 102 and the conical emitters 115 to be deteriorated, so that dipping of the laminated board in the phosphoric acid solution for removal of the peel layer 105 and emitter mateial 106 causes the conical emitters 115 formed on the resistive layer 102 to be peeled off therefrom.

Also, even when the conical emitters 115 are not peeled off, the above-described deterioration in bonding between the resistive layer 102 and the conical emitters 115 causes an increase in contact resistance between the resistive layer 102 and the conical emitters 115, leading to a non-uniform distribution of emission current fed from the conical emitters 115, resutling in emission characteristics of the conical emitters being unstable.

SUMMARY OF THE INVENTION

The present invention has been made in view of the foregoing disadvantage of the prior art.

Accordingly, it is an object of the present invention to provide a field emission cathode which is capable of permitting bond strength between emitters and a resistive layer to be significantly increased.

It is another object of the present invention to provide a field emission cathode which is capable of being readily manufactured.

It is a further object of the present invention to provide a method for manufacturing a field emission cathode which is capable of providing a field emission cathode increased in bond strength between emitters and a resistive layer.

It is still another object of the present invention to provide a method for manufacturing a field emission cathode which is capable of facilitaing production of the cathode.

In accordance with one aspect of the preent invention, there is provided a method for manufacturing a field emission cathode which includes a laminated board including a substrate, and at least a cathode electrode layer, a resistive layer, an insulating layer and a gate electrode layer which are deposited in the form of a film on the substrate in order, wherein the gate electrode layer and insulating layer are formed with through-holes so as to commonly extend through the gate electrode layer and insulating layer. The through-holes have emitters arranged therein, respectively. The method comprises the step of depositing buffer layers on portions of the insulating layer exposed via the through-holes. The buffer layers each are made of an conductive material. The method further comprises the step of forming the emitters on the buffer layers, respectively.

In accordance with another aspect of the present invention, a field emission cathode is provided. The field emission cathode includes a laminated board including a substrate, and at least a cathode electrode layer, a resitive layer, an insulating layer and a gate electrode layer which are deposited in the form of a film on the substrate in order. The gate electrode layer and insulating layer are formed with through-holes so as to commonly extend through the gate electrode layer and insulating layer. The field emission cathode also includes emitters arranged in the through-holes, respectively, buffer layers formed on portions of the resistive layer exposed via the through-holes, respectively. The emitters are arranged on the buffer layers, respectively, whereby bond strength between the resistive layer and the emitters is increased.

In a preferred embodiment of the present invention, the emitters are made of an emitter material selected from a group consisting of a high-melting metal material, a carbon material, a nitride, a silicon compound and a carbide.

In a preferred embodiment of the present invention, the buffer layers are made of a semiconductor or a conductive material having a melting point lower than the emitter material.

In the present invention constructed as described above, the gate electrode layer and insulating layer deposited on the insulating substrate are commonly formed with the through-holes, followed by deposition of a conductive material on the portions of the resistive layer exposed via the through-holes to provide the buffer layers, resulting in bond strength between the resistive layer and the buffer layer being significantly increased. Then, the emitters are formed on the buffer layers, respectively, so that the buffer layers permit bond strength between the resistive layer and the emitters to be increased therethough.

Also, in the present invention, formation of the buffer layer is carried out after formation of the through-holes via the gate electrode layer and insulating layer, so that manufacturing of the field emission cathode is facilitated.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENT

Now, the present invention will be detailedly described hereinafter with reference to FIGS. 1 and 2(*a*) to 2(*e*).

Figure 1:
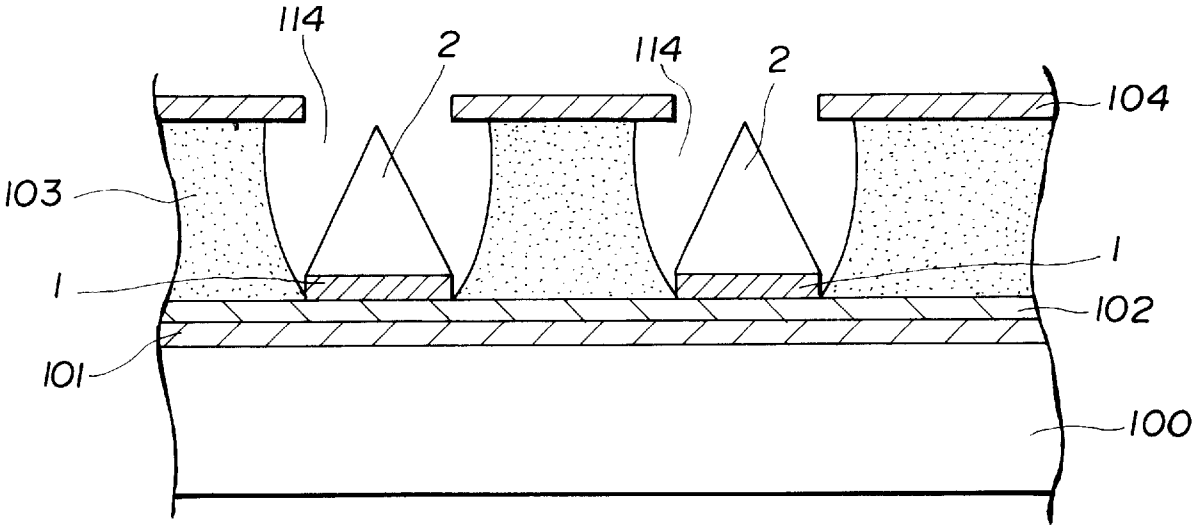
FIG. 1 is a fragmentary vertical sectional view showing an essential part of an embodiment of a field emission cathode according to the present invention.
Figure 2A:
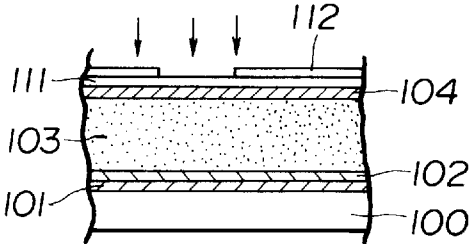
FIGS. 2(*a*) to 2(*f*) each are a fragmentary sectional view showing each of steps in a method for manufacturing a field emission cathode according the present invention.
Figure 2B:
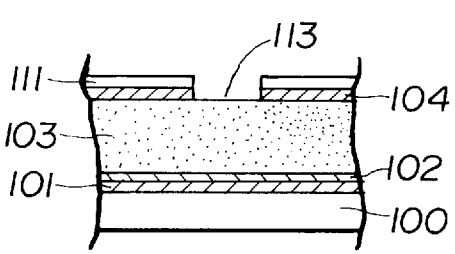
Figure 2C:
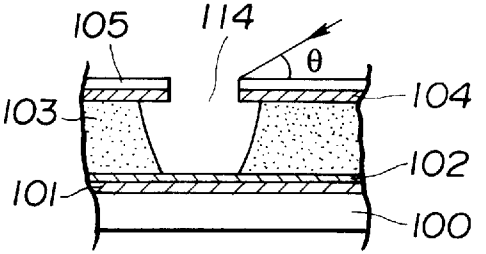
Figure 2D:
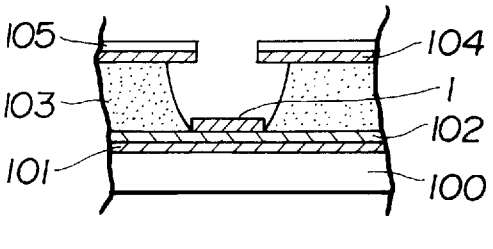
Figure 2E:
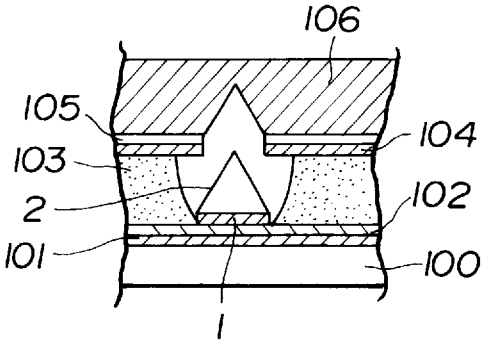
Figure 2F:
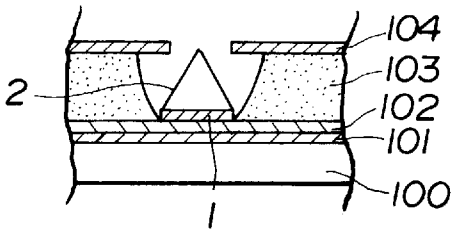
Figure 3:
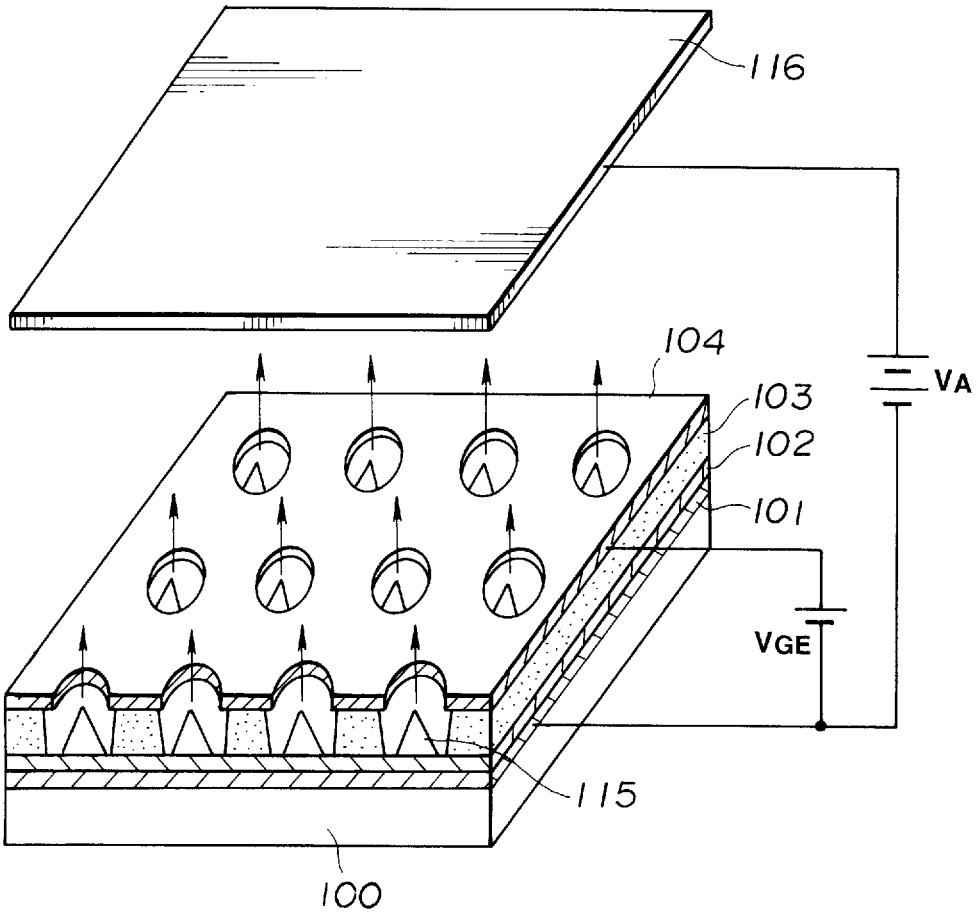
FIG. 3 is an exploded perpsective view showing a display device having an FEC array incorporated therein.
Figure 4A:
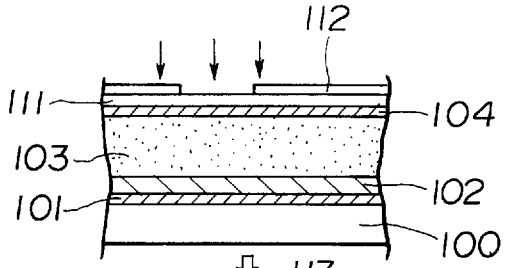
FIGS. 4(*a*) to 4(*e*) are a fragmentary sectional view showing each of steps in an example of a conventional method for manufacturing a field emission cathode.
Figure 4B:
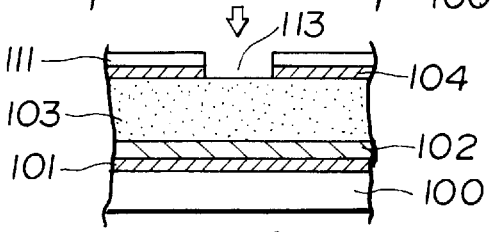
Figure 4C:
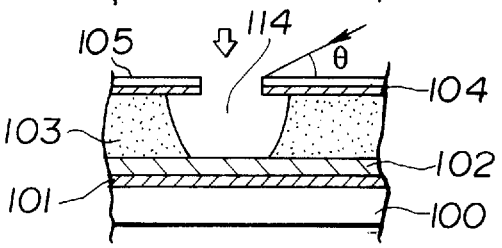
Figure 4D:
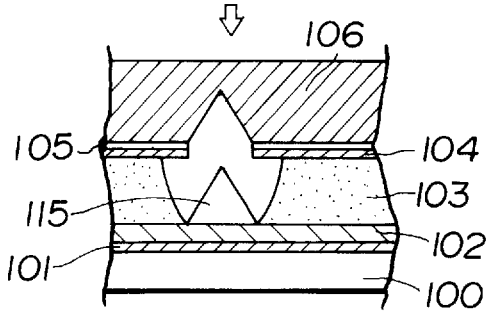
Figure 4E:
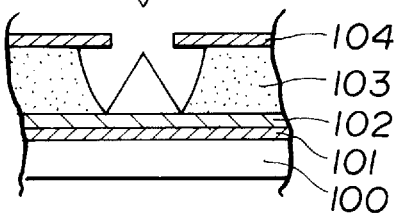

Referring first to FIG. 1, an embodiment of a field emission cathode according to the present invention is illustrated. A field emission cathode of the illustrated embodiment, as shown in FIG. 1, includes a glass substrate 100, on which a cathode electrode layer 101 is arranged in the form of a film. The cathode electrode layer 101 is made of niobium (Nb). The cathode electrode layer 101 is formed thereon with a resistive layer 102 in the form of a film. The resistive layer 102 may be made of, for example, amorphous silicon (α-Si) doped with an impurity.

The field emission cathode also includes an insulating layer 103 made of silicon dioxide ($SiO_2$) and arranged on the resistive layer 102. The insulating layer 103 is formed with through-holes 114. The resistive layer 102 is formed on a portion thereof facing the through-holes 114 of the insulating layer 103 or exposed therethrough with buffer layers 1, which may be made of a semiconductor or a conductive material having a melting point lower than an emitter material described below. The buffer layers 1 each are formed thereon with conical emitter 2 made of any suitable emitter material such as, for example, a high-melting metal material, a carbon material, a nitride, a silicon compound, a carbide or the like. Then, the insulating layer 103 is formed thereon with a gate electrode layer 104, which is made of Nb.

Now, the manner of manufacturing of the thus-constructed FEC of the illustrated embodiment will be described hereinafter with reference to FIGS. 2(*a*) to 2(*e*).

First, as shown in FIG. 2(*a*), a cathode material such as Nb or the like is deposited in the form of a film on the substrate 100 by sputtering, to thereby provide the cathode electrode layer 101. The substrate 100 may be made of glass or the like. Then, the resistive layer 102 is formed on the cathode electrode layer 101 thus formed. The resistive layer 102 may be made of a silicon material such as α-Si doped with an impurity or the like and formed into a film-like shape by CVD.

Then, a film of silicon dioxide ($SiO_2$) is formed on the resistive layer 102 by CVD, resulting in the insulating layer 103 being provided. Thereafter, the insulating layer 103 is formed thereon with a film of Nb or the like by sputtering, to thereby provide the gate electrode layer 104, so that a laminated board is provided.

Then, a photoresist layer 111 is deposited on the gate electrode layer 104 which is an uppermost layer of the laminated board and then subject to patterning by photolithography while being covered with a mask 112, resulting in the photoresist layer 111 being formed with an opening pattern.

Subsequently, the laminated board is subject to reactive ion etching (RIE) on a side of the photoresist layer 111 by means of any suitable gas such as $SF_6$ or the like, resulting in being subject to anisotropic etching, so that the gate electrode layer 104 is formed with openings 113 like the photoresist pattern, as shown in FIG. 2(*b*).

Thereafter, the laminated board is subject to dry etching, resulting in the insulating layer 103 being subject to anisotropic etching using $CHF_3$+$O_2$ or the like through the openings 113, so that the insulating layer 103 is formed with the above-described through-holes 114 as shown in FIG. 2(*c*). Thus, the through-holes 113 are arranged in communication with the openings 113, resulting in cooperating with the openings 113 to provide holes in the laminated board. Then, metal such as aluminum (Al), nickel (Ni) or the like is formed on the lamited board by oblique vapor deposition (angle: θ) while rotating the laminated board in the same plane, so that a peel layer 105 may be provided. This results in Al being selectively formed on only a surface of the gate electrode layer 104 without being deposited in the through-holes 114, as shown in FIG. 2(*c*).

Subsequently, as shown in FIG. 2(*d*), metal such as chromium (Cr), Titanium (Ti), Tungsten (W) or the like is deposited, by electron beam deposition, on a portion of the resistive layer 102 exposed through each of the through-holes 114, to thereby provide the buffer layer 1.

Then, the emitter material is formed on each of the buffer layers 1 arranged in the through-holes 114 by electron beam deposition, ion plating or the like. The emitter materials include high-melting materials such as molybdenum (Mo), niobium (Nb), tungsten (W), titanium (Ti), tantalum (Ta), cobalt (Co), hafnium (Hf), iridium (Ir), silicon (Si), lanthanum (La), manganese (Mn), osmium (Os), palladium (Pd), platinum (Pt), rhenium (Re), rhodium (Rh), ruthenium (Ru), scandium (Sc), thorium (Th), vanadium (V), zirconium (Zr) and beryllium (Be); nitrides of at least one of the high-melting materials; and oxides thereof.

For example, supposing that the emitter material which is deposited is Mo, it is deposited on each of the buffer layers 1, to thereby form the conical emitter 2 on the buffer layer 1, as shown in FIG. 2(*e*). Concurreently, the emitter material Mo is also deposited on the peel layer 105 as indicated at reference numeral 106 in FIG. 2(*e*). The emitter material 106 thus deposited on the peel layer 105 closes the openings 113. Then, the laminated board is then dipped in a phosphoric acid solution for dissolving the peel layer 105, so that both the peel layer 105 on the gate electrode layer 104 and the emitter material are removed from the laminated board, resulting in the FEC being provided as shown in FIG. 2(*f*).

As described above, the FEC of the illustrated embodiment is so constructed that the resistive layer 102 made of α-Si is formed on the portion thereof exposed through each of the through-holes 114 of the insulating layer 103 with the buffer layer 1, which is made of Cr deposited. Such construction permits bond strength between the resistive layer 102 and the buffer layer 1 to be increased even when the surface of the resistive layer 102 made of α-Si is deterirated during formation of the through-holes 114 via the insulating layer.

Thus, formation of Mo or the like into the conical emitter 2 on each of the buffer layers 1 leads to an increase in bond strength between the buffer layer 1 and the conical emitter 2, resulting in preventing peel or removal of the conical emitter 2 from the buffer layer 1 when the laminated board is dipped in the phosphoric acid solution for the purpose of removing the peel layer 105 and emitter material 106 from the gate electrode layer 104.

Also, the above-described construction of the FEC of the illustrated embodiment permits bond strength between the resistive layer 102 and the conical emitter 115 to be increased because the buffer layer 1 is interposedly arranged therebetween, to thereby render a distribution of an emmision current fed from the conical emitter 2 uniform, so that emission characteristics of the conical emitter 2 may be rendered stable.

Further, manufacturing of the FEC is so carried out that the holes each including each of the through-holes 114 of the insulating layer 103 are formed in the laminated board in a manner to extend through a part of the laminated board, followed by formation of the buffer layer 1 on the portion of the resistive layer 102 exposed via each of the through-holes 114. This eliminates arrangement of any mask for formation of the buffer layer 1 and alignment therefor, to thereby facilitate the manufacturing.

As can be seen from the foregoing, the field emission cathode of the present invention is manufactured in the manner that the laminated board is formed with the holes in a manner to extend through a part thereof and then the buffer layer is depositedly formed of a conductive material on the portion of the resistive layer exposed through each of the holes, followed by formation of the emitter on the buffer layer. Thus, manufacturing of the field emission cathode is facilitated while ensuring an increase in bond strength between the resistive layer and the emitter.

Further, in the field emission cathode of the present invention, the buffer layer is formed of a conductive material on the portion of the resistive layer exposed through each of the holes formed in the laminated board in a manner to extend through a part of the board and the emitter is formed on the buffer layer, so that the buffer layer interposed between the resistive layer and emitter contributes to an increase in bond strengh therebetween.

Thus, it will be noted that the field emission cathode of the present invention reduces contact resistance between the resistive layer and the emitter, to thereby permit an emission current fed from the emitter to be uniformly distributed, resulting in ensuring stable emission characteristics of the emitter.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A field emission cathode comprising:

a laminated board including a substrate, and at least a cathode electrode layer, a resitive layer, an insulating layer and a gate electrode layer which are deposited in the form of a film on said substrate in order;

said gate electrode layer and insulating layer being formed with through-holes so as to commonly extend through said gate electrode layer and insulating layer;

emitters arranged in said through-holes, respectively;

buffer layers formed on portions of said resistive layer exposed via said through-holes, respectively;

said emitters being arranged on said buffer layers, respectively;

whereby bond strength between said resistive layer and said emitters is increased.

2. A field emission cathode as defined in claim 1, wherein said emitters are made of an emitter material selected from a group consisting of a high-melting metal material, a carbon material, a nitride, a silicon compound and a carbide.

3. A field emission cathode as defined in claim 1, wherein said buffer layers are made of a semiconductor or a conductive material having a melting point lower than said emitter material.

* * * * *

UNITED STATES PATENT AND TRADEMARK OFFICE

CERTIFICATE OF CORRECTION

PATENT NO. : 5,834,885

DATED : November 10, 1998

INVENTOR(S) : Shigeo ITOH, et al.

It is certified that error appears in the above-indentified patent and that said Letters Patent is hereby corrected as shown below:

On the title page, item [30] has been omitted. It should be:

--[30] Foreign Application Priority Data

Dec. 13, 1995 [JP] Japan ..... 7-346273--

Signed and Sealed this

First Day of June, 1999

*Attest:*

*Attesting Officer*

Q. TODD DICKINSON

*Acting Commissioner of Patents and Trademarks*